US006154894A

United States Patent [19]

Alexander et al.

[11] Patent Number: 6,154,894

[45] Date of Patent: Dec. 5, 2000

[54] SHOWER CURTAIN CLOSURE SYSTEM

[76] Inventors: Richard N. Alexander, P.O. Box 623; Robert O'Dwyer, P.O. Box 414, both of Cashiers, N.C. 28717

[21] Appl. No.: 09/345,840

[22] Filed: Jul. 1, 1999

[51] Int. Cl.[7] ..... A47K 3/38

[52] U.S. Cl. ..... 4/609; 4/558; 4/608

[58] Field of Search ..... 4/608, 609, 558

[56] References Cited

U.S. PATENT DOCUMENTS

| | | | |
|---|---|---|---|
| 2,212,326 | 8/1940 | Piken | 4/608 X |
| 4,887,324 | 12/1989 | Cairns | 4/609 |
| 4,888,835 | 12/1989 | Baumann | 4/609 |
| 5,787,520 | 8/1998 | Dunbar | 4/609 |

*Primary Examiner*—Charles E. Phillips

[57] ABSTRACT

A shower curtain closure system for keeping a shower curtain fully extended across opposite walls of a bathtub area. The shower curtain closure system includes a flexible shower curtain for downwardly depending from the shower curtain rod. The shower curtain has a pair of side edges. The system also include a pair of elongate angle rods. Each of the angle rods has a longitudinal axis, exterior and interior faces, and first and second elongate portions substantially perpendicular to each other such that each angle rod has a generally L-shaped transverse cross section taken from a plane substantially perpendicular to the longitudinal axis of the respective angle rod. The first elongate portion of the angle rods is designed for coupling opposing wall surfaces adjacent a bathtub such that the second elongate portions of the angle rods are extended towards each other. One of the side edges of the shower curtain is detachably attached to second elongate portion of one of the angle rods and the other of the side edges of the shower curtain is detachably attached to the other of the side edges of the shower curtain.

5 Claims, 3 Drawing Sheets

11
12
15
16
18
19
22
20
21
24
25
14
10
13

20
34
24
28
26
35
23
16
29
19
27
36
17
35

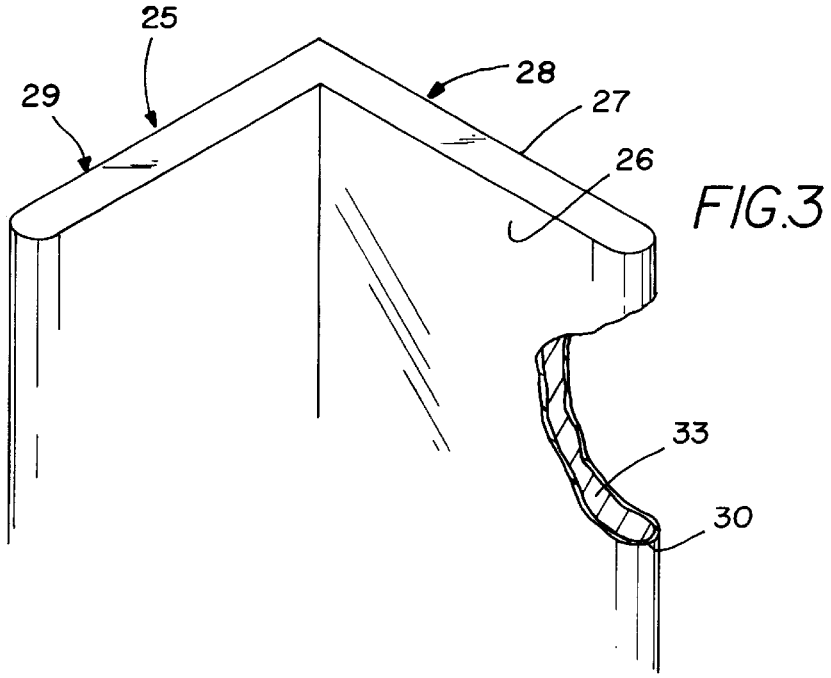
FIG.3
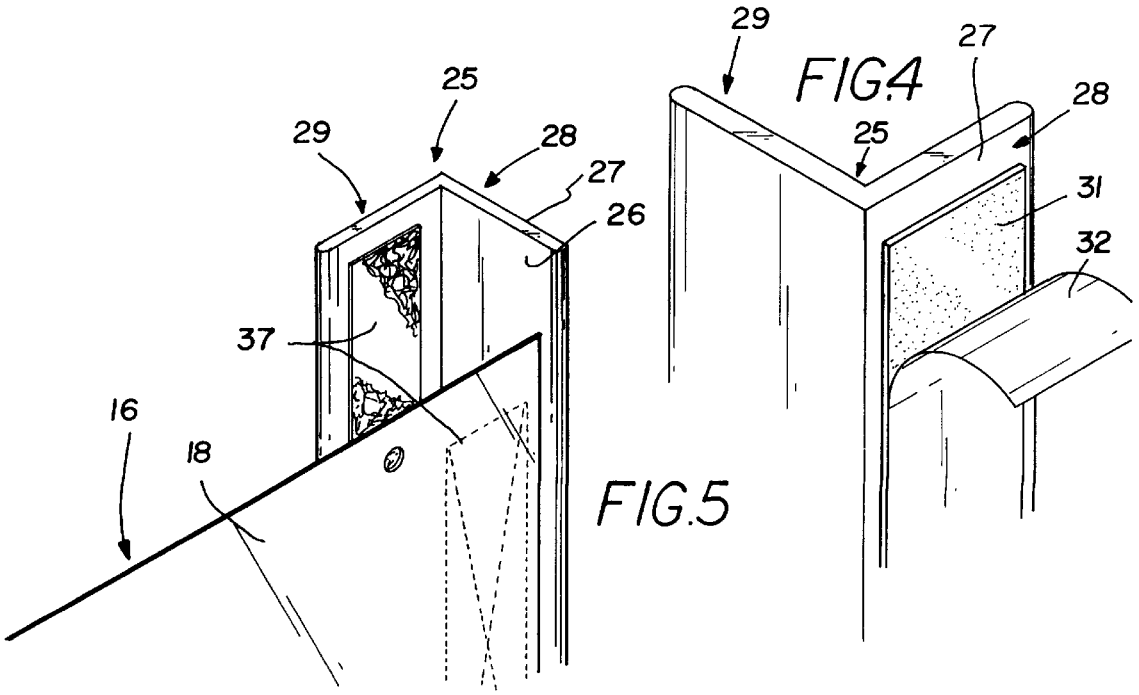
FIG.4
FIG.5

36
12
14
10
13

SHOWER CURTAIN CLOSURE SYSTEM

BACKGROUND OF THE INVENTION

1. Field of the Invention

The present invention relates to systems for keeping a shower curtain fully extended across opposite walls of a bathtub area and more particularly pertains to a new shower curtain closure system for keeping a shower curtain fully extended across opposite walls of a bathtub area.

2. Description of the Prior Art

The use of systems for keeping a shower curtain fully extended across opposite walls of a bathtub area is known in the prior art. More specifically, systems for keeping a shower curtain fully extended across opposite walls of a bathtub area heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,148,580; 4,594,741; U.S. Pat. No. 5,228,149; U.S. Pat. No. 3,639,919; U.S. Pat. No. 3,365,684; and U.S. Pat. No. Des. 284,024.

While these devices fulfill their respective, particular objectives and requirements, the aforementioned patents do not disclose a new shower curtain closure system. The inventive device includes a flexible shower curtain for downwardly depending from the shower curtain rod. The shower curtain has a pair of side edges. The system also include a pair of elongate angle rods. Each of the angle rods has a longitudinal axis, exterior and interior faces, and first and second elongate portions substantially perpendicular to each other such that each angle rod has a generally L-shaped transverse cross section taken from a plane substantially perpendicular to the longitudinal axis of the respective angle rod. The first elongate portion of the angle rods is designed for coupling opposing wall surfaces adjacent a bathtub such that the second elongate portions of the angle rods are extended towards each other. One of the side edges of the shower curtain is detachably attached to second elongate portion of one of the angle rods and the other of the side edges of the shower curtain is detachably attached to the other of the side edges of the shower curtain.

In these respects, the shower curtain closure system according to the present invention substantially departs from the conventional concepts and designs of the prior art, and in so doing provides an apparatus primarily developed for the purpose of keeping a shower curtain fully extended across opposite walls of a bathtub area.

SUMMARY OF THE INVENTION

In view of the foregoing disadvantages inherent in the known types of systems for keeping a shower curtain fully extended across opposite walls of a bathtub area now present in the prior art, the present invention provides a new shower curtain closure system construction wherein the same can be utilized for keeping a shower curtain fully extended across opposite walls of a bathtub area.

The general purpose of the present invention, which will be described subsequently in greater detail, is to provide a new shower curtain closure system apparatus and method which has many of the advantages of the systems for keeping a shower curtain fully extended across opposite walls of a bathtub area mentioned heretofore and many novel features that result in a new shower curtain closure system which is not anticipated, rendered obvious, suggested, or even implied by any of the prior art systems for keeping a shower curtain fully extended across opposite walls of a bathtub area, either alone or in any combination thereof.

To attain this, the present invention generally comprises a flexible shower curtain for downwardly depending from the shower curtain rod. The shower curtain has a pair of side edges. The system also include a pair of elongate angle rods. Each of the angle rods has a longitudinal axis, exterior and interior faces, and first and second elongate portions substantially perpendicular to each other such that each angle rod has a generally L-shaped transverse cross section taken from a plane substantially perpendicular to the longitudinal axis of the respective angle rod. The first elongate portion of the angle rods is designed for coupling opposing wall surfaces adjacent a bathtub such that the second elongate portions of the angle rods are extended towards each other. One of the side edges of the shower curtain is detachably attached to second elongate portion of one of the angle rods and the other of the side edges of the shower curtain is detachably attached to the other of the side edges of the shower curtain.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new shower curtain closure system apparatus and method which has many of the advantages of the systems for keeping a shower curtain fully extended across opposite walls of a bathtub area mentioned heretofore and many novel features that result in a new shower curtain closure system which is not anticipated, rendered obvious, suggested, or even implied by any of the prior art systems for keeping a shower curtain fully extended across opposite walls of a bathtub area, either alone or in any combination thereof.

It is another object of the present invention to provide a new shower curtain closure system which may be easily and efficiently manufactured and marketed.

It is a further object of the present invention to provide a new shower curtain closure system which is of a durable and reliable construction.

An even further object of the present invention is to provide a new shower curtain closure system which is susceptible of a low cost of manufacture with regard to both materials and labor, and which accordingly is then susceptible of low prices of sale to the consuming public, thereby making such shower curtain closure system economically available to the buying public.

Still yet another object of the present invention is to provide a new shower curtain closure system which provides in the apparatuses and methods of the prior art some of the advantages thereof, while simultaneously overcoming some of the disadvantages normally associated therewith.

Still another object of the present invention is to provide a new shower curtain closure system for keeping a shower curtain fully extended across opposite walls of a bathtub area.

Yet another object of the present invention is to provide a new shower curtain closure system which includes a flexible shower curtain for downwardly depending from the shower curtain rod. The shower curtain has a pair of side edges. The system also include a pair of elongate angle rods. Each of the angle rods has a longitudinal axis, exterior and interior faces, and first and second elongate portions substantially perpendicular to each other such that each angle rod has a generally L-shaped transverse cross section taken from a plane substantially perpendicular to the longitudinal axis of the respective angle rod. The first elongate portion of the angle rods is designed for coupling opposing wall surfaces adjacent a bathtub such that the second elongate portions of the angle rods are extended towards each other. One of the side edges of the shower curtain is detachably attached to second elongate portion of one of the angle rods and the other of the side edges of the shower curtain is detachably attached to the other of the side edges of the shower curtain.

Still yet another object of the present invention is to provide a new shower curtain closure system that helps prevent water from a shower in a bathtub from passing through gaps between a wall of the bathtub area and a shower curtain to help keep the bathroom floor dry.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a schematic breakaway perspective view of an end of an angle rod of the present invention.

FIG. 4 is a schematic perspective view of an angle rod with an adhesive strip provided thereon.

FIG. 5 is a schematic perspective view of a portion of an embodiment of the present invention having a hook and loop fastener attaching the angle rods to the shower curtain.

DESCRIPTION OF THE PREFERRED EMBODIMENT

Figure 1:
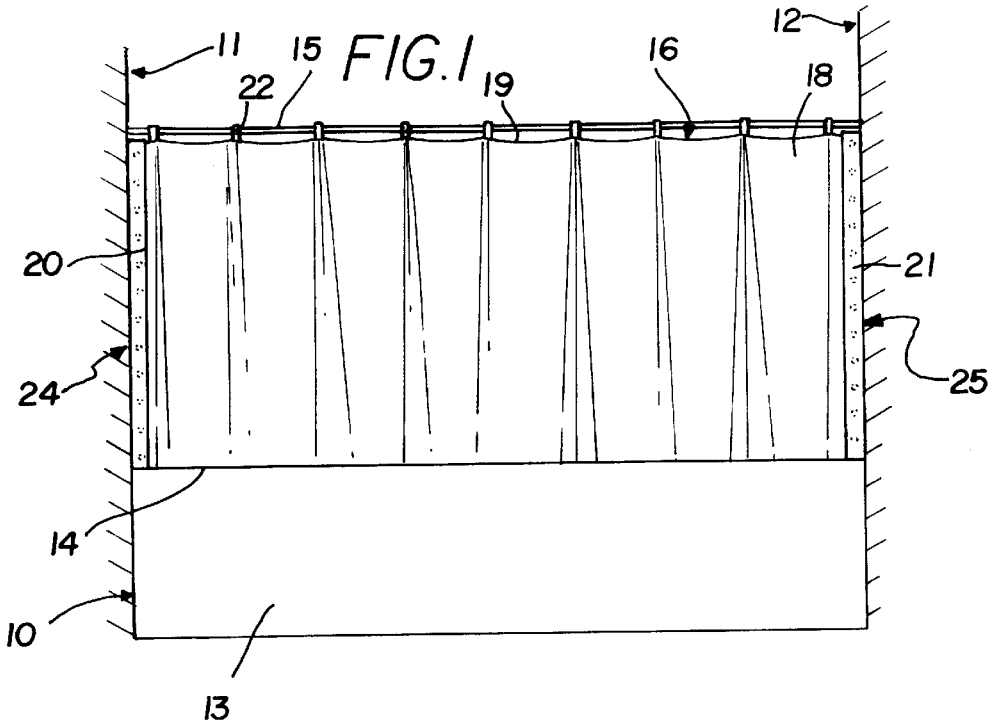
FIG. 1 is a schematic plan view of a new shower curtain closure system according to the present invention.
Figure 2:
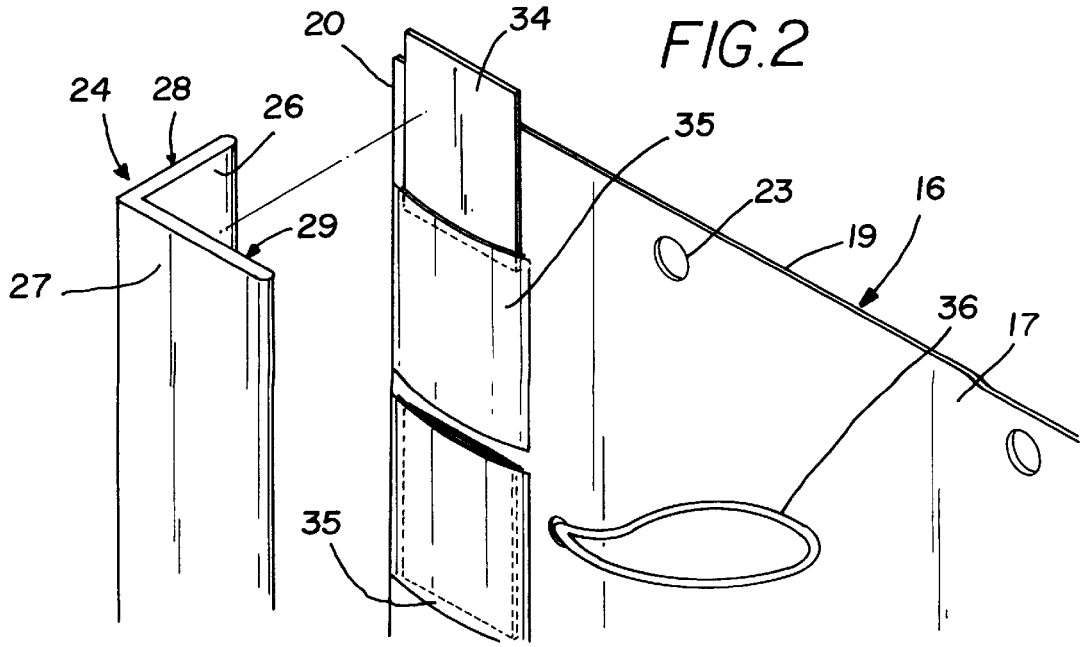
FIG. 2 is a schematic enlarged perspective view of a side edge and angle rod of the present invention.

With reference now to the drawings, and in particular to FIGS. 1 through 6 thereof, a new shower curtain closure system embodying the principles and concepts of the present invention will be described.

As best illustrated in FIGS. 1 through 6, the shower curtain closure system generally comprises a flexible shower curtain for downwardly depending from the shower curtain rod. The shower curtain has a pair of side edges. The system also include a pair of elongate angle rods. Each of the angle rods has a longitudinal axis, exterior and interior faces, and first and second elongate portions substantially perpendicular to each other such that each angle rod has a generally L-shaped transverse cross section taken from a plane substantially perpendicular to the longitudinal axis of the respective angle rod. The first elongate portion of the angle rods is designed for coupling opposing wall surfaces adjacent a bathtub such that the second elongate portions of the angle rods are extended towards each other. One of the side edges of the shower curtain is detachably attached to second elongate portion of one of the angle rods and the other of the side edges of the shower curtain is detachably attached to the other of the side edges of the shower curtain.

In closer detail the shower curtain closure system is designed for use in conjunction with a bathtub 10 interposed between a pair of opposing vertical wall surfaces 11,12. The bathtub has a perimeter side wall with an exposed side 13 extending between the wall surfaces and an upper face 14 extending at least across the exposed side of the perimeter side wall. A shower curtain rod 15 is extended between the wall surfaces above the exposed side of the bathtub.

The system includes a flexible shower curtain 16 which downwardly depends from the shower curtain rod. The shower curtain has inwards and outwards faces 17,18, and a generally rectangular outer perimeter comprising a substantially horizontal upper edge 19, a substantially horizontal lower edge, and a pair of substantially vertical side edges 20,21 extending between the upper and lower edges of the shower curtain.

The upper edge of the shower curtain typically has a plurality of shower curtain rings 22 coupled thereto by extension through a plurality of holes 23 along the upper edge of the shower curtain. The shower curtain rings are slidably mounting the upper edge of the shower curtain to the shower curtain rod.

The system also includes a pair of elongate angle rods 24,25. Each of the angle rods has a longitudinal axis, exterior and interior faces 26,27, and first and second elongate portions 28,29 substantially perpendicular to each other such that each angle rod has a generally L-shaped transverse cross section taken from a plane substantially perpendicular to the longitudinal axis of the respective angle rod.

Each of the angle rods may even have a resilient outer coating substantially covering the respective angle rod to prevent the angle rods from scratching adjacent surfaces. In one such embodiment, the outer coating may comprise a resilient rubber or plastic material. Optionally, the outer coating may even comprise a fiberglass material.

The first elongate portion of one of the angle rods is coupled to one of the wall surfaces and the first elongate portion of the other of the angle rods is coupled to the other of the wall surfaces adjacent the exposed side of the perimeter side wall of the bathtub. The angle rods are extended between the upper face of the perimeter side wall of the bathtub and the shower rod such that an upper end of each angle rod is positioned adjacent the shower rod and a lower end of each angle rod is positioned adjacent the upper face of the perimeter side wall of the bathtub. In this arrangement, the longitudinal axes of the angle rods are extended substantially vertically along the wall surfaces.

In one embodiment, the interior faces of the angle rods each may have an adhesive strip 31 provided along the first elongate portion of the respective angle rod to adhesively couple the first elongate portions of the angle rods to the wall surfaces. Optionally, each adhesive strip may be covered by a peelable protective backing 32 thereon which is removed prior to coupling of the respective angle rod to the associated wall surface.

The second elongate portions of the angle rods are extended towards each other from their respective side walls when the angle rods are mounted to the wall surfaces. In this arrangement, the exterior faces of the angle rods along the second elongate portions of the angle rods face outwards from the bathtub.

One of the side edges of the shower curtain is detachably attached to second elongate portion of one of the angle rods and the other of the side edges of the shower curtain is detachably attached to the other of the side edges of the shower curtain. In particular, the side edges of the shower curtain may be attached to the second elongate portion of the respective angle rod on the exterior face of the respective angle rod.

In one embodiment, each of the angle rods comprises a magnetizable metal 33. In this embodiment, the side edges of the shower curtain are magnetically detachably attached to the second elongate portion of the respective angle rod. In such an embodiment, the inwards face of the shower curtain may have a plurality of magnets 34 provided thereon with at least one of the magnets is positioned adjacent one of the side edges of the shower curtain and at least one other of the magnets is positioned adjacent the other of the side edges of the shower curtain for magnetically detachably attaching each side edge to the respective angle rod.

In one embodiment, the magnets may be flat and generally rectangular in shape. In one such embodiment, the inwards face of the shower curtain may have a plurality of pockets 35 arranged into a pair of rows. Each pocket has one of the magnet disposed therein. One of the rows of pockets is extended along one of the side edges of the shower curtain and the other of the rows of pockets is extended along the other of the side edges of the shower curtain. The pockets may be spaced apart at substantially equal intervals in the respective row of pockets. the inwards face of the shower curtain has at least one pull loop 36 coupled thereto adjacent one of the side edge of the shower curtain towards the upper edge of the shower curtain for aiding the moving of the shower curtain along the shower curtain rod.

With reference to FIG. 5, in one optional embodiment, a hook and loop fastener 37 may be used to detachably attaches each side edge of the shower curtain to the second elongate portion of the adjacent associated angle rod.

Figure 6:
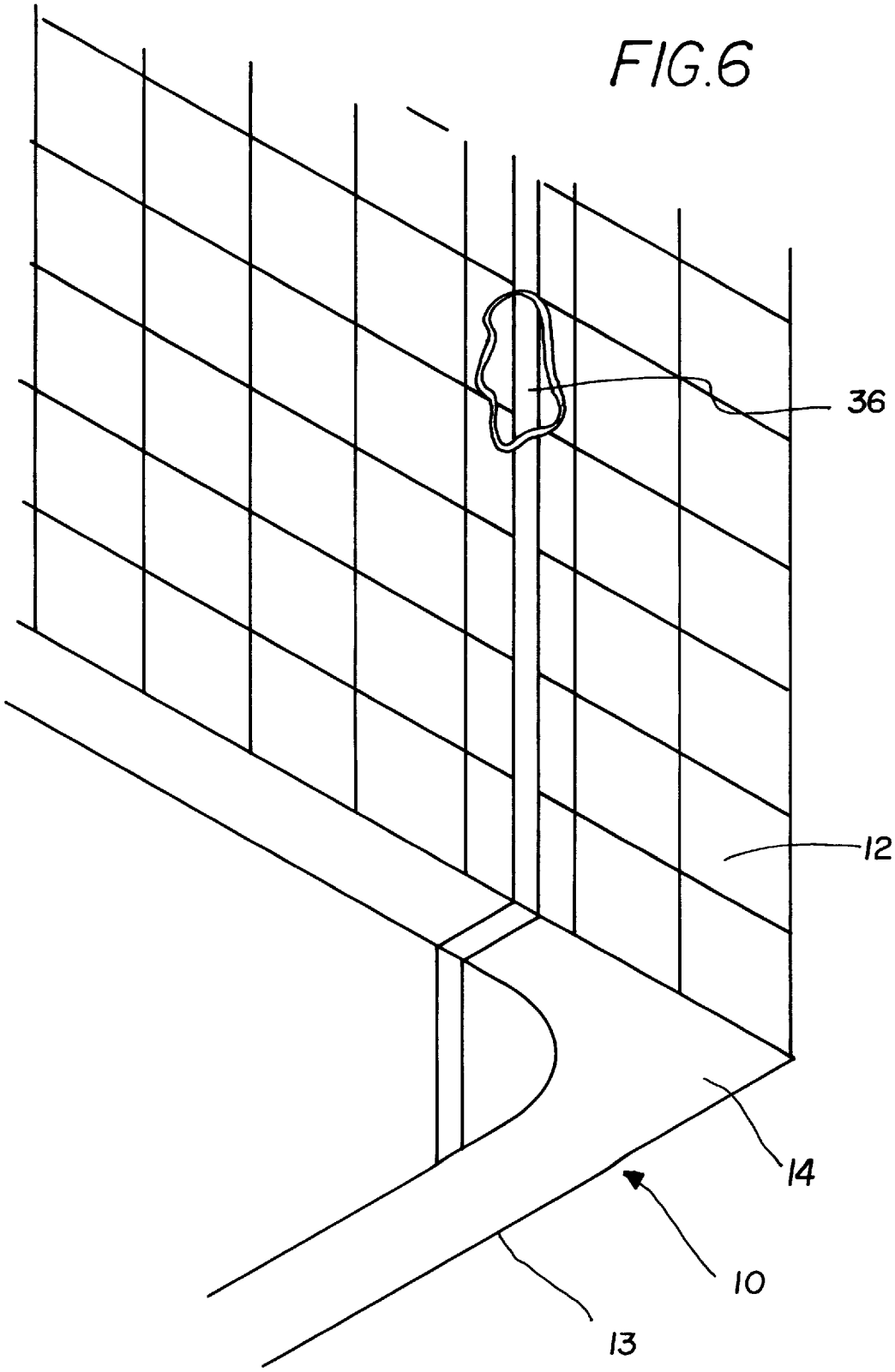
FIG. 6 is a schematic perspective view of another embodiment of the present invention with a rod molded into the wall surface and bathtub for magnetically attaching the side edges of the shower curtain thereto.

In another optional embodiment, as illustrated in FIG. 6, a magnetizable metal rod 38 may be embedded into each wall surface, each rod extending vertically along each wall surface and has a lower region extending along an adjacent portion of the upper face and perimeter side wall of the bathtub. This embodiment provides a secure closure between the side edges of the shower curtain down past the upper face of the perimeter side wall of the bathtub.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A shower curtain closure system for a bathtub interposed between a pair of opposing vertical wall surfaces with a shower curtain rod extending between said wall surfaces above said bathtub, said shower curtain closure system comprising:

a flexible shower curtain for downwardly depending from said shower curtain rod;

said shower curtain having a pair of side edges;

a pair of elongate angle rods;

each of said angle rods having a longitudinal axis, exterior and interior faces, and first and second elongate portions substantially perpendicular to each other such that each angle rod has a generally L-shaped transverse cross section taken from a plane substantially perpendicular to said longitudinal axis of the respective angle rod;

said first elongate portion of said angle rods being adapted for coupling opposing wall surfaces adjacent a bathtub such that said second elongate portions of said angle rods are extended towards each other;

one of said side edges of said shower curtain being detachably attached to second elongate portion of one of said angle rods and the other of said side edges of said shower curtain being detachably attached to the other of said side edges of said shower curtains;

wherein each of said angle rods comprises a magnetizable metal, wherein said side edges of said shower curtain are magnetically detachably attached to the second elongate portion of the respective angle rod;

wherein said shower curtain has a plurality of magnets provided thereon, at least one of said magnets being positioned adjacent one of said side edges of said shower curtain and at least one other of said magnets being positioned adjacent the other of said side edges of said shower curtain for magnetically detachably attaching each side edge to the respective angle rod; and wherein said shower curtain has a plurality of pockets arranged into a pair of rows, one of said rows of pockets being extended along one of said side edges of said shower curtain and the other of said rows of pockets being extended along the other of said side edges of said shower curtain, each pocket having one of said magnets disposed therein, each of said pockets having an open upper end such that said magnet of said respective pocket can be removed and cleaned when necessary.

2. The shower curtain closure system of claim 1, wherein each of said angle rods has a resilient outer coating substantially covering the respective angle rod.

3. The shower curtain closure system of claim 1, wherein said pockets are spaced apart at substantially equal intervals in the respective row of pockets.

4. The shower curtain closure system of claim 3, wherein said shower curtain has at least pull loop coupled thereto adjacent one of said side edge of said shower curtain.

5. A shower curtain closure system, comprising:

a bathtub interposed between a pair of opposing vertical wall surfaces;

said bathtub having a perimeter side wall, said perimeter side wall of said bathtub having an exposed side extending between said wall surfaces and an upper face extending at least across said exposed side of said perimeter side wall;

a shower curtain rod being extended between said wall surfaces above said exposed side of said bathtub;

a flexible shower curtain downwardly depending from said shower curtain rod;

said shower curtain having inwards and outwards faces, and a generally rectangular outer perimeter comprising substantially horizontal upper and lower edges and a pair of substantially vertical side edges extending between said upper and lower edges of said shower curtain;

said upper edge of said shower curtain having a plurality of shower curtain rings coupled thereto, said shower curtain rings being extended through a plurality of holes adjacent said upper edge of said shower curtain said shower curtain rings slidably mounting said upper edge of said shower curtain to said shower curtain rod;

a pair of elongate angle rods;

each of said angle rods having a longitudinal axis, exterior and interior faces, and first and second elongate portions substantially perpendicular to each other such that each angle rod has a generally L-shaped transverse cross section taken from a plane substantially perpendicular to said longitudinal axis of the respective angle rod;

each of said angle rods having a resilient outer coating substantially covering the respective angle rod;

said first elongate portion of one of said angle rods being coupled to one of said wall surfaces and said first elongate portion of the other of said angle rods being coupled to the other of said wall surfaces adjacent said exposed side of said perimeter side wall of said bathtub;

said angle rods being extended between said upper face of said perimeter side wall of said bathtub and said shower rod such that an upper end of each angle rod is positioned adjacent said shower rod and a lower end of each angle rod is positioned adjacent said upper face of said perimeter side wall of said bathtub;

said longitudinal axes of said angle rods being extended substantially vertically along said wall surfaces;

wherein said interior faces of said angle rods each have an adhesive strip providing along said first elongate portion of the respective angle rod to adhesively couple said first elongate portions of said angle rods to said wall surfaces;

each adhesive strip having a peelable protective backing such that said protective backing is removable from said adhesive strip for securing said respective angle rod to said associated wall surface;

said second elongate portions of said angle rods being extended towards each other;

said exterior faces of said angle rods along said second elongate portions of said angle rods facing outwards from said bathtub;

one of said side edges of said shower curtain being detachably attached to second elongate portion of one of said angle rods and the other of said side edges of said shower curtain being detachably attached to the other of said side edges of said shower curtain;

wherein said side edges of said shower curtain are attached to the second elongate portion of the respective angle rod on said exterior face of the respective angle rod;

each of said angle rods comprising a magnetizable metal;

said side edges of said shower curtain being magnetically detachably attached to the second elongate portion of the respective angle rod;

said inwards face of said shower curtain having a plurality of magnets provided thereon, at least one of said magnets being positioned adjacent one of said side edges of said shower curtain and at least one other of said magnets being positioned adjacent the other of said side edges of said shower curtain for magnetically detachably attaching each side edge to the respective angle rod;

wherein said magnets are flat and generally rectangular in shape;

said inwards face of said shower curtain having a plurality of pockets arranged into a pair of rows, one of said rows of pockets being extended along one of said side edges of said shower curtain and the other of said rows of pockets being extended along the other of said side edges of said shower curtain, each of said pockets having an open upper end such that said magnet of said respective pocket can be removed and cleaned when necessary;

said pockets being spaced apart at substantially equal intervals in the respective row of pockets;

each pocket having one of said magnet disposed therein; and said inwards face of said shower curtain having at least pull loop coupled thereto adjacent one of said side edge of said shower curtain towards said upper edge of said shower curtain for aiding movement of said shower curtain along said shower curtain rod.

* * * * *